US005690541A

United States Patent [19]

Dalke

[11] Patent Number: 5,690,541

[45] Date of Patent: Nov. 25, 1997

[54] METHODS AND APPARATUS FOR POLISHING SEAL SURFACES IN A NUCLEAR REACTOR

[75] Inventor: Charles Arthur Dalke, San Jose, Calif.

[73] Assignee: General Electric Company, Schenectady, N.Y.

[21] Appl. No.: 541,613

[22] Filed: Oct. 10, 1995

[51] Int. Cl.[6] ..... B24B 15/03

[52] U.S. Cl. ..... 451/63; 451/51; 451/61; 451/359

[58] Field of Search ..... 451/430, 359, 451/278, 51, 61, 63, 548

[56] References Cited

U.S. PATENT DOCUMENTS

| | | | |
|---|---|---|---|
| 1,871,228 | 8/1932 | Stout et al. | 451/548 |
| 2,632,984 | 3/1953 | Kaplan | 451/430 |
| 2,720,736 | 10/1955 | McAfee | 451/430 |
| 4,610,112 | 9/1986 | Kelsey | 451/430 |
| 4,958,464 | 9/1990 | Menendez | 451/430 |

FOREIGN PATENT DOCUMENTS

| | | | |
|---|---|---|---|
| 570229 | 4/1924 | France | 451/359 |
| 0122715 | 9/1959 | U.S.S.R. | 451/430 |

*Primary Examiner*—Robert A. Rose

*Attorney, Agent, or Firm*—Armstrong, Teasdale, Schlafly and Davis

[57] ABSTRACT

Methods and apparatus for polishing seal surfaces in a nuclear reactor are described. One embodiment of the apparatus includes a universal joint which has a universal joint housing and a drive shaft extending therefrom. A polishing plate is secured to the universal joint housing. A working surface of the polishing plate is configured to polish the seal surfaces. The seal surfaces of incore monitor housings and valves may, for example, be polished using various embodiments of the apparatus.

20 Claims, 1 Drawing Sheet

METHODS AND APPARATUS FOR POLISHING SEAL SURFACES IN A NUCLEAR REACTOR

FIELD OF THE INVENTION

This invention relates generally to forming seals to prevent the leakage of coolant water in a nuclear reactor and, more particularly, to a tool for polishing seal surfaces in a reactor.

BACKGROUND OF THE INVENTION

Seals which prevent the leakage of reactor water are formed at many locations within a nuclear reactor including, for example, at incore monitors and valves. Incore monitors generally are utilized in a nuclear reactor to generate signals representative of core conditions. Such monitors may be located at various locations with respect to the core. For example, a number of monitors, e.g., sixty (60) monitors, may be located at spaced locations within the core housing. Each monitor typically is mounted within an incore monitor (ICM) housing which extends through the reactor pressure vessel (RPV) wall and is accessible at the core wall exterior surface.

In one particular configuration, an ICM housing has a substantially cylindrical shape with a bore extending therethrough. A flange is formed at one end of the bore, and a substantially planar, ring shaped surface is located at the one end of bore. The ring shaped surface forms a seal surface. The center axis of the seal surface is substantially coaxial with the center axis of the cylindrical bore. An o-ring, which may be attached to and form a part of the incore monitor assembly, may be utilized to form a seal with the ICM housing seal surface.

To best ensure that no reactor coolant can escape from the RPV through the ICM housing, it is important to remove any scratches or imperfections from the ICM housing seal surface. Any such imperfections or scratches on the seal surface may, for example, enable leakage of the reactor coolant water at the location of the scratch. Leakage of coolant water, of course, is undesirable.

Known apparatus for polishing ICM housing seal surfaces include hand held tools to hand polish the seal surfaces. Such known tools, however, do not provide any self-aligning mechanism nor are such tools positively stable. As a result, after polishing a seal surface with such known tools, the surface may be uneven and may not enable formation of a proper seal with the monitor o-ring. Therefore, the ICM housing seal surface may have to be re-worked many times before a satisfactory result, i.e., formation of an acceptable seal, can be obtained. Such polishing also may be time consuming and require skilled workers.

With respect to valve sealing surfaces or seats, as with the ICM housing seal surface, it is important to remove any scratches or imperfections to prevent leakage of coolant water. Many of the shortcomings set forth above with respect to the ICM housing seal surface polishing tools exist with known valve sealing surface polishing tools.

Accordingly, it is desirable to provide that the ICM housing and valve seal surfaces are substantially scratch free so that a reliable seal can be formed. It also is desirable to provide a polishing apparatus which is both self-aligning and positively stabilized so that the seal surfaces may be more quickly polished with improved quality.

SUMMARY OF THE INVENTION

These and other objects are attained by methods and apparatus for polishing the seal surfaces of incore monitor housings and valves which, in one embodiment, is both self-aligning and positively stabilized. More particularly, in the one embodiment, the apparatus includes a universal joint which includes a universal joint housing and a drive shaft having a first end and a second end. The universal joint housing is secured to a polishing plate adjacent a first working surface of the plate. A ball joint seating surface is formed on an interior surface of the housing. The universal joint further includes a ball joint located within the housing and seated on the seating surface. The drive shaft extends through the universal joint housing, and one end of the drive shaft is press fit into engagement with the ball joint.

In one embodiment of the apparatus for polishing the seal surfaces of incore monitoring housings, the polishing plate has a substantially planar first working surface. An opening is formed in the plate and the center axis of the opening is substantially coaxial with the center axis of the plate. The polishing plate is secured to the universal joint housing and the drive shaft extends through the opening in the polishing plate. The first working surface of the polishing plate has a polishing material, e.g., emery paper, secured thereto.

In accordance with the one embodiment, the universal joint housing has a substantially cylindrical shape, and the diameter of the universal joint housing is less than the diameter of the incore monitoring housing bore. The universal joint housing, therefore, may be at least partially positioned within the incore monitor housing bore during a polishing operation.

To polish the seal surface of an incore monitor housing, and in one form of operation of the above described apparatus, the drive shaft may be coupled to a driver motor. The driver motor causes the drive shaft to rotate. The universal joint and polishing plate rotate with the drive shaft. The universal joint housing is aligned with the bore of the ICM housing so that the center axis of the universal joint housing is substantially coaxial with the center axis of the ICM housing bore, and the universal joint housing may be at least partially inserted within the ICM housing bore so that the polishing material secured to the first working surface of the polishing plate contacts, and polishes, the seal surface of the ICM housing.

The polishing apparatus described above provides the important advantages of being self-aligning and positively stabilized. As a result, ICM housing and valve seal surfaces may be polished more evenly, which may facilitate formation of better seals. In addition, use of such polishing apparatus may eliminate the need to re-work the seal surface a number of times before achieving a satisfactory seal surface. As a result, use of such apparatus may reduce the time required to polish seal surfaces. Also, since the polishing apparatus is relatively easy to use, highly trained workers may not be required to perform the polishing operation.

DETAILED DESCRIPTION OF THE DRAWINGS

Figure 1:
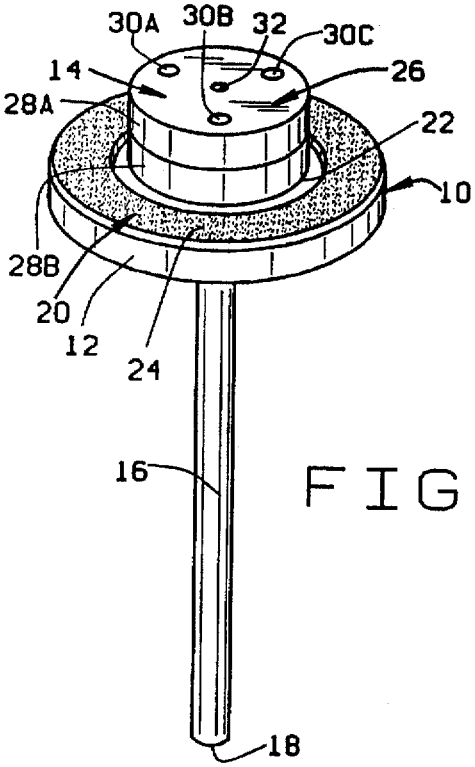
FIG. 1 is a perspective view of one embodiment of a polishing tool.

FIG. 1 is a perspective view of one embodiment of a polishing apparatus or tool 10 which includes a polishing plate 12 and a spherical ball type universal joint 14. Universal joint 14 includes a drive shaft 16 having a first end 18 and a second end (not shown in FIG. 1). First end 18 of drive shaft 16 is configured to couple to a driver motor (not shown). Polishing plate 12 has a substantially planar first working surface 20 and is configured for polishing the seal surfaces of ICM housings as hereinafter described in more detail. An opening 22 is formed in plate 12 and the center axis of opening 22 is substantially coaxial with the center axis of plate 12. First working surface 20 of polishing plate 12 has a polishing material such as emery paper 24 secured thereto using an adhesive such as an epoxy. Emery paper 24 may, for example, be cut to have a ring shape so that such paper can be easily removed and replaced without having to remove universal joint 14.

Universal joint 14 includes, in addition to drive shaft 16, a two-part universal joint housing 26 having a first housing member 28A and a second housing member 28B. First and second housing members 28A and 28B are secured to each other by threaded screws 30A, 30B and 30C. An opening 32 is provided in first housing member 28A to enable lubrication of universal joint 14 as hereinafter explained. Universal joint housing 26 has a substantially cylindrical shape.

Figure 2:
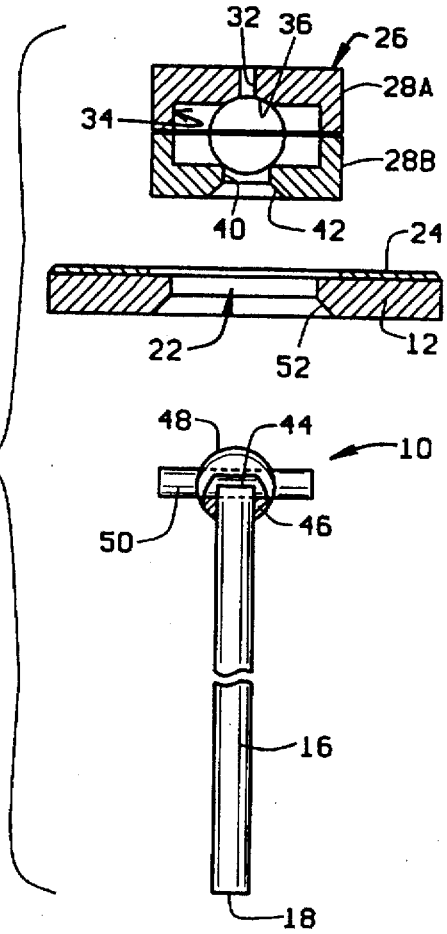
FIG. 2 is an exploded view, with some parts shown in cross-section, of the polishing tool shown in FIG. 1.

FIG. 2 is an exploded view, with some parts shown in cross-section, of polishing tool 10 shown in FIG. 1. As shown in FIG. 2, first and second housing members 28A and 28B form a drive pin chamber or slot 34 and a ball seat 36. An opening 40 having a tapered section 42 is formed in second member 28B.

With respect to shaft 16, a second end 44 of shaft 16 is positioned, or press fit, within an opening 46 formed in a ball 48. Ball 48 is sized to be positioned on seat 36 of first and second housing members 28A and 28B. A spring or roll pin 50 extends through ball 48 so that the center axis of pin 50 is substantially perpendicular to the center axis of drive shaft 16. Pin 50 functions to transmit the driving torque of drive shaft 16 to universal joint housing 26 and to limit the movement of shaft 16 relative to housing 26 as described hereinafter in detail.

To assemble tool 10, the following process steps may be executed. Particularly, emery paper 24 is pressure bonded to polishing plate 12 using an adhesive as hereinbefore described. Specifically, the adhesive may be applied to surface 20 of plate 12 and emery paper 24 is pressed against surface 20 using a substantially flat block. The pressure bond between paper 24 and plate 12 facilitates ensuring that paper 24 is substantially planar, or flat, with no lumps resulting from the bonding material. Maintaining paper 24 flat is, of course, important in facilitating a polishing operation.

Roll pin 50 may be press fit into an opening formed in and extending through ball 48. Opening 46 may then be formed in ball 48 by drilling through a portion of ball 48 and pin 50. Second end 44 of shaft 16 may then be press fit into such opening 46.

Prior to engaging first housing member 28A to second housing member 28B, first end 18 of shaft 16 may be inserted through opening 40 in second housing member 28 so that shaft 16 extends through opening 40. First and second housing members 28A and 28B can then be engaged together using screws 30A, 30B and 30C so that ball 48 rests in seat 36. Shaft 16 also extends through opening 22, having a tapered portion 52, in polishing plate 12.

Figure 3:
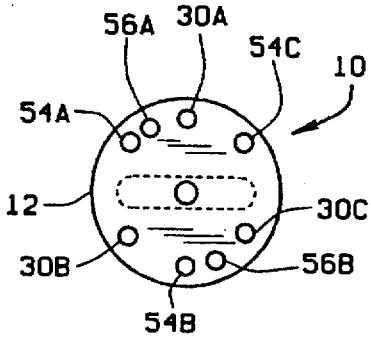
FIG. 3 is a top view of the polishing tool shown in FIG. 1.

As best shown in FIG. 3, which is a top view of tool 10, polishing plate 12 is secured to universal joint 14 at second housing member 28B using three screws 54A, 54B and 54C. Shear pins 56A and 56B may be press fit into respective aligned openings in first and second housing members 28A and 28B and polishing plate 12. Shear pins 56A and 56B are utilized to transmit driving torque and to limit relative movement between housing members 28A and 28B and polishing plate 12. Screws 54A, 54B and 54C, and shear pins 56A and 56B are positioned so as to not adversely affect polishing material 24, i.e., material 24 is substantially planar with no significant bumps or lumps therein. All components of tool 10, except of course for polishing material 24, may be made from steel or other well-known material suitable for polishing operations.

Figure 4:
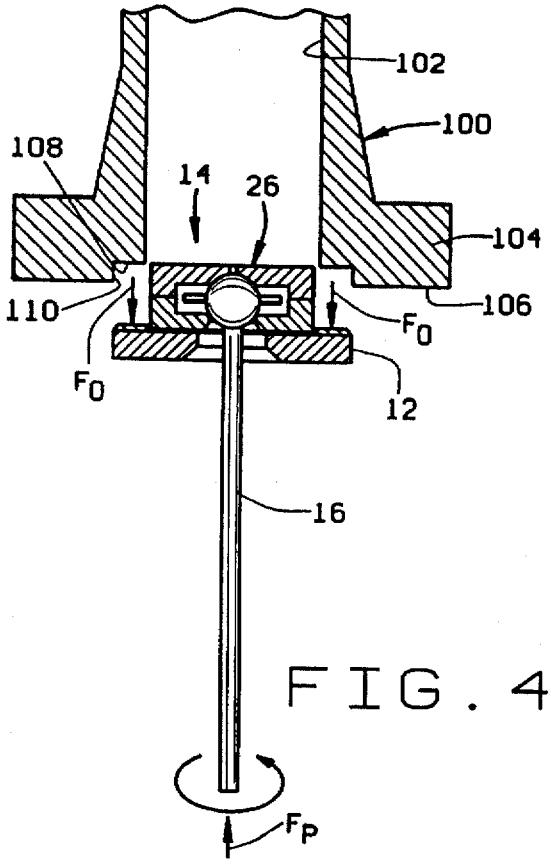
FIG. 4 is a side view, with some parts shown in cross-section, of the polishing tool shown in FIG. 1 positioned with respect to an incore monitor housing.

FIG. 4 is a side view, with some parts shown in cross-section, of polishing tool 10 positioned with respect to an incore monitor housing 100. ICM housing 100 has a substantially cylindrical shape with a bore 102 extending therethrough. A flange 104 is formed at a first end 106 of bore 102, and a substantially planar, ring shaped surface 108 is located at first end 106 of bore 102. A plane which is substantially co-planar with surface 108 also is substantially perpendicular to the center axis of bore 102. The center axis of surface 108 is substantially coaxial with the center axis of cylindrical bore 102. Surface 108 may cooperate with an o-ring of an incore monitor (not shown) to form a seal.

To best ensure that no reactor coolant from the core can escape from the core through ICM housing bore 102, it is important to remove any scratches or imperfections from ICM housing seal surface 108. Any scratches on such seal surface 108 may, for example, enable leakage of the reactor coolant water at the location of the scratch. Leakage of coolant water, of course, is undesirable.

As shown in FIG. 4, the diameter of universal joint housing 26 is less than the diameter of the incore monitoring housing bore 102. In one specific embodiment, the diameter of housing 26 may be approximately about 4.8 mm less than the diameter of bore 102. Universal joint housing 26, therefore, may be at least partially positioned within bore 102 during a polishing operation. Also, the clearance space between polishing plate 12 and wall 110, in one specific embodiment, may be approximately about 0.25 mm. Such dimensions may, of course, vary depending upon the particular ICM housing.

To polish seal surface 108 of incore monitor housing 100, and in one form of operation of tool 10, first end 18 of drive shaft 16 may be coupled to a driver motor (not shown). The driver motor causes drive shaft 16 to rotate. Polishing plate 12 and housing 26 rotate with drive shaft 16. Universal joint housing 26 is aligned with bore 102 of ICM housing 100 so that the center axis of universal joint housing 26 is substantially coaxial with the center axis of ICM housing bore 102, and universal joint housing 26 may be at least partially inserted within ICM housing bore 102 so that polishing material 24 of polishing plate 12 contacts seal surface 108 of ICM housing 100.

The normal polishing force $F_p$ is applied to drive shaft 16, and such force is transmitted through ball 48 to housing 26 at seat 36, and to polishing plate 12 and emery paper 24. Polishing force $F_p$ is reacted by opposing force $F_o$ equally distributed over the surface of emery paper 24 by seal surface 108.

As polishing material 24 polishes seal surface 108 of ICM housing 100, polishing plate 12 cooperates with wall 110 to maintain alignment of polishing material 24 with seal surface 108. Plate 12 therefore functions as an alignment member. Positive stability is achieved by the orientation of universal joint 14 with respect to normal polishing force $F_p$ and opposing force $F_o$.

Ball 48 is movable within seat 36 so that shaft 16 can be positioned at many different angular orientations relative to housing 26. The particular angular orientation selected for a polishing operation depends primarily on the location of ICM housing 100. Roll pin 50, however, cooperates with the interior surfaces of housing 26 defining slot 34 to limit the extent of such angular positioning. Lubricant, such as oil, may be injected onto ball 48 through opening 32 to ease movement of ball 48 with respect to seat 36.

Polishing tool 10 provides many important advantages including self-alignment and positive stabilization described above. Such a construction facilitates reliably and consistently removing scratches and other imperfections from seal surface 108, which enables formation of good seals with the incore monitor o-ring. In addition, since tool 10 is self-aligning and positively stabilized, use of polishing tool 10 may eliminate the need to rework seal surface 108 a number of times before a satisfactory seal can be provided. As a result, use of tool 10 may reduce the time required to polish ICM seal surfaces 108. Also, since tool 10 is relatively easy to use, highly trained workers may not be required to perform the polishing operation.

Although tool 10 as described above is configured for polishing the seal surfaces of ICM housings, it is contemplated that working surface 20 of polishing plate 12 could be configured to have many other shapes. For example, working surface 20 could have a conical or spherical shape so that tool 10 may be used in connection with valve sealing surfaces or seats. For use in such applications, the shape or geometry of surface 20 may be made to the same geometry as the seal surface to be polished, e.g., conical or spherical.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A tool for polishing a seal surface in a nuclear reactor, the seal surface being substantially ring shaped and having an opening extending therethrough, said tool comprising:

a universal joint comprising a universal joint housing and a drive shaft having a first and a second end, said second end of said drive shaft configured to couple to a driver motor, said housing having a substantially cylindrical shape and forming a chamber and a ball joint seating surface, said universal joint further comprising a ball joint located substantially within said chamber and seated on said seating surface, said drive shaft extending through an opening in said housing and into engagement with said ball joint; and a polishing plate having a working surface, an opening formed in said plate, a center axis of the polishing plate opening substantially coaxial with a center axis of said plate, said polishing plate secured to said universal joint housing so that a portion of a side surface of said plate is in substantial surface to surface contact with a side surface of said housing and so that said housing is substantially completely positioned on the working surface side of said plate, said drive shaft extending through the polishing plate opening to said ball joint, said universal joint housing extending from said polishing plate working surface and configured to substantially align said polishing plate working surface with the seal surface.

2. A tool in accordance with claim 1 wherein said ball joint has an opening formed therein and extending at least partially therethrough, and said second end of said drive shaft is press fit within the opening in the ball joint.

3. A tool in accordance with claim 1 wherein said ball joint further comprises a roll pin extending therethrough, said roll pin cooperating with said housing to limit movement of said ball joint.

4. A tool in accordance with claim 1 wherein said universal joint housing has a substantially cylindrical shape.

5. A tool in accordance with claim 1 wherein said universal joint housing is formed by first and second housing members, said housing members cooperating to form the chamber, an interior surface of said first housing member having said ball joint seating surface formed therein.

6. A tool in accordance with claim 5 wherein said ball joint has an opening formed therein and extending partially therethrough, and said second end of said drive shaft being press fit within the opening in the ball joint, said ball joint further comprising a roll pin extending therethrough, said roll pin cooperating with said housing to limit movement of said ball joint.

7. A tool in accordance with claim 5 wherein the seal surface forms part of a monitor housing having a substantially cylindrical bore and a flange formed at one end of the bore, the seal surface located at the one end of the bore, the center axis of the seal surface being substantially coaxial with the center axis of the cylindrical bore of the monitor housing, the diameter of said universal joint housing being less than the diameter of the incore monitoring housing bore so that said universal joint housing may be at least partially positioned within the bore, and said polishing plate working surface is substantially planar.

8. A tool in accordance with claim 5 wherein the seal surface forms part of a valve, the seal surface being substantially conical, and said polishing plate working surface is substantially conical shaped.

9. A tool in accordance with claim 1 wherein said first working surface of said polishing plate has a polishing material secured thereto.

10. A tool in accordance with claim 8 wherein said polishing material is emery paper, said emery paper being adhesively secured to said polishing plate.

11. A method for polishing a seal surface in a nuclear reactor using a polishing tool, the seal surface being substantially ring shaped and having an opening extending therethrough, said seal surface located adjacent an end of a bore, the polishing tool including a polishing plate with a working surface and a universal joint comprising a drive shaft and universal joint housing secured to the polishing plate adjacent the working surface, the housing having a substantially cylindrical shape, the polishing plate having a polishing material secured thereto, said method comprising the steps of:

aligning the tool with the seal surface so that a center axis of the universal joint housing is substantially coaxial with a center axis of the seal surface, aligning the tool with the seal surface comprising the step of inserting substantially the entire universal joint housing through the seal surface opening so that substantially the entire outer surface of the housing cooperates with the surface of the bore to substantially align the polishing plate working surface with the seal surface; and rotating the polishing plate while the working surface of the plate is in contact with the seal surface.

12. A method in accordance with claim 11 wherein the working surface of the polishing plate includes a polishing material.

13. A method in accordance with claim 11 wherein the polishing plate and shaft are coupled, and the shaft is coupled to a driver motor so that when the shaft rotates, the polishing plate rotates therewith.

14. A method in accordance with claim 13 wherein the shaft is coupled to a ball joint positioned within the universal joint housing.

15. Apparatus for polishing a seal surface in a nuclear reactor, the seal surface being substantially ring shaped and having an opening extending therethrough, said apparatus comprising:

a universal joint including a drive shaft, said universal joint comprising a substantially cylindrical housing; and an alignment member having a working surface, said alignment member being coupled to said universal joint, said universal joint housing substantially completely located on the working surface side of said alignment member and extending beyond said alignment member working surface and configured to facilitate substantially aligning said alignment member working surface with the seal surface.

16. Apparatus in accordance with claim 15 wherein said universal joint housing forms a chamber and a ball joint seating surface, said universal joint further comprising a ball joint located substantially within said chamber and seated on said seating surface, said drive shaft being in engagement with said ball joint.

17. Apparatus in accordance with claim 16 wherein the seal surface is a substantially planar surface positioned at a first end of a substantially cylindrical bore, a plane which is substantially co-planar with the seal surface being substantially perpendicular to a center axis of the bore, a center axis of the seal surface being substantially coaxial with the center axis of the bore, and said working surface is substantially planar.

18. Apparatus in accordance with claim 17 wherein said universal joint housing is formed by first and second housing members, said housing members cooperating to form the chamber, an interior surface of said first housing member having said ball joint seating surface formed therein, said universal joint further comprising a ball joint seated on said ball joint seating surface, said ball joint having an opening formed therein and extending partially therethrough, and an end of said drive shaft being press fit within the opening in the ball joint, said ball joint further comprising a roll pin extending therethrough, said roll pin cooperating with said housing to limit movement of said ball joint.

19. Apparatus in accordance with claim 16 wherein said working surface has a substantially conical shape.

20. A tool in accordance with claim 15 wherein said first working surface of said polishing plate includes a polishing material.

* * * * *